US005364035A

United States Patent [19]

Ma et al.

[11] Patent Number: 5,364,035

[45] Date of Patent: Nov. 15, 1994

[54] HIGH VOLTAGE SEALING AND ISOLATION VIA DYNAMIC SEALS

[75] Inventors: Yamin Ma, Roseville; Lawrence J. Lunzer, St. Louis Park, both of Minn.; Norman N. Fender, Farmington Hills, Mich.

[73] Assignee: Graco Inc., Golden Valley, Minn.

[21] Appl. No.: 170,538

[22] Filed: Dec. 20, 1993

[51] Int. Cl.[5] ..... B05B 5/025

[52] U.S. Cl. ..... 239/690; 239/112; 239/135

[58] Field of Search ..... 239/128, 135, 690, 691, 239/104, 112

[56] References Cited

U.S. PATENT DOCUMENTS

| | | | |
|---|---|---|---|
| 4,879,137 | 11/1989 | Behr et al. | 239/112 |
| 4,884,752 | 12/1989 | Plummer | 239/691 |
| 4,921,169 | 5/1990 | Tilly | 239/690 |
| 5,078,168 | 1/1992 | Konieczynski | 239/691 |
| 5,083,711 | 1/1992 | Giroux et al. | 239/690 |
| 5,094,389 | 3/1992 | Giroux et al. | 239/690 |
| 5,096,126 | 3/1992 | Giroux et al. | 239/690 |
| 5,199,650 | 4/1993 | Ishibashi et al. | 239/690 |
| 5,249,748 | 10/1993 | Lacchia et al. | 239/690 |
| 5,255,856 | 10/1993 | Ishibashi et al. | 239/690 |
| 5,271,569 | 12/1993 | Konieczynski et al. | 239/690 |
| 5,288,029 | 2/1994 | Ishibashi et al. | 239/690 |

*Primary Examiner*—Karen B. Merritt

*Attorney, Agent, or Firm*—Palmatier, Sjoquist & Helget

[57] ABSTRACT

A liquid pumping system for transporting conductive liquids to an electrostatic spraying device while maintaining electrical isolation between the spraying device and the liquid source; the system includes sequentially-arranged metering valves and pumps to sequentially transport predetermined and isolated quantities of liquid.

13 Claims, 8 Drawing Sheets

HIGH VOLTAGE SEALING AND ISOLATION VIA DYNAMIC SEALS

BACKGROUND OF THE INVENTION

The present invention relates to spray painting devices; more particularly, the invention relates to a device for the electrostatic spraying of conductive, water-base liquids.

The technique of electrostatic spraying is well known, wherein a high electrostatic voltage is used in association with a spray gun in order to develop electrostatic charges on the sprayed liquid particles. The charged particles become strongly attracted to an article which is maintained at an electrical neutral voltage, and a high percentage of the particles which are sprayed actually land on the surface. This technique greatly reduces overspray and reduces the problems associated therewith, including the problem of environmental pollution.

Electrostatic spraying becomes more difficult when conductive liquids are sprayed, as for example water-base paints. Under these conditions, the electrically-charged paint particles are still needed for spray coating applications, but the conductive liquid column which moves through the spray system tends to short circuit the voltage to ground, and thereby interrupt the voltage-charging capability of the system. This problem has been dealt with in a number of different ways in the past, including using a peristaltic-type pump for voltage isolation, as is disclosed in U.S. Pat. No. 4,982,903. Another approach has been to electrically isolate all components associated with the liquid column, including the liquid container which holds the supply of liquid to be sprayed. These approaches necessarily complicate the construction and operation of such system, and tend to create a hazardous workplace. Examples of system constructions where insulated components have been used in an electrostatic spraying system include U.S. Pat. No. 4,879,137, issued Nov. 7, 1989; U.S. Pat. No. 5,083,710, Jan. 28, 1992; U.S. Pat. No. 5,094,389, issued Mar. 10, 1992; and U.S. Pat. No. 5,096,126, issued Mar. 17, 1992.

SUMMARY OF THE INVENTION

A system for conveying water-base liquids to an electrostatic spray painting device for the electrostatic application thereof, including a plurality of liquid handling devices for sequentially moving controlled volumes of the liquid, while providing electrical isolation between the sequential liquid volumes. A liquid transport device comprises the apparatus for maintaining electrical isolation, wherein the transport device includes one or more metering valves moving within cylinders, the metering valves transporting limited volumes of liquid through a system, with voltage isolation maintained between each limited volume.

A method for transporting limited volumes of conductive liquid through a flow system leading to an electrostatic voltage-charging delivery device, so as to provide voltage isolation between the voltage-charged liquid in the delivery device and the transportable liquid volumes in the system.

It is a principal object of the present invention to provide a system for conveying electrically-conductive liquids in controlled-volume quantities with electrical isolation therebetween and a method for conveying the controlled-volume liquid quantities to maintain voltage isolation.

It is a further object and advantage of the invention to provide a solvent washing function as a part of a voltage-isolation method.

It is another object and advantage of the present invention to convey conductive liquids by a transport device having electrical insulating qualities.

It is a further object and advantage of the present invention to provide a liquid metering valve with controllable liquid flow lines to provide voltage isolation.

The foregoing and other objects and advantages of the invention will become apparent from the specification and claims, and with reference to the appended drawings.

DESCRIPTION OF THE PREFERRED EMBODIMENT

Figure 1:
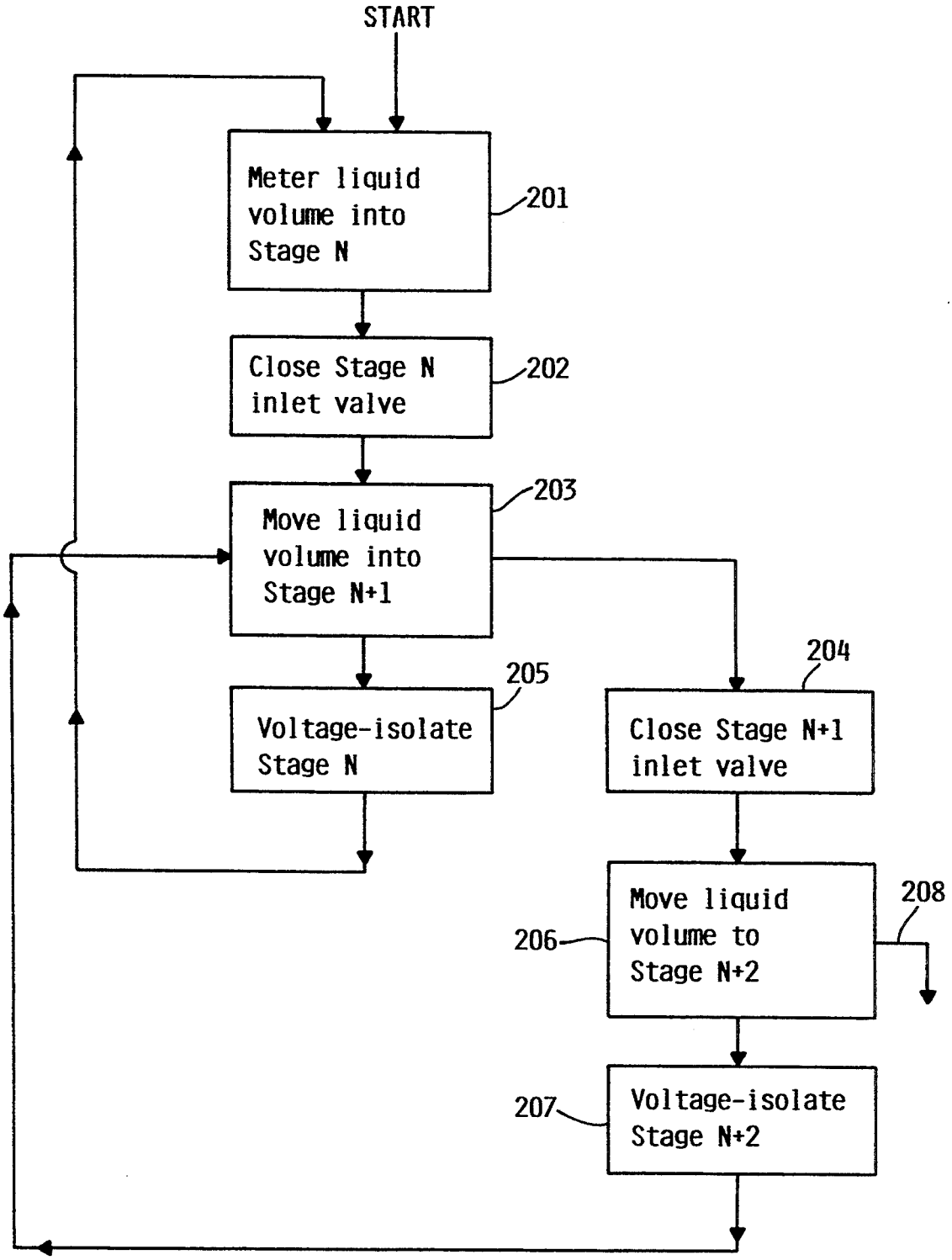
FIG. 1 shows a flow chart of the method of the present invention.

Referring first to FIG. 1, a flow chart showing the overall method of the invention is illustrated. Broadly speaking, the method comprises a series of steps wherein a predetermined volume of conductive liquid is sequentially moved through a number of stages, wherein each cycle of the sequence involves a liquid-transporting stage and a liquid-receiving stage. As the liquid-transporting stage conveys the controlled liquid volume into the next subsequent liquid-receiving stage, a voltage-isolation step is executed wherein the transporting stage becomes voltage isolated from the next subsequent receiving stage. As the cycle progresses, a transporting stage becomes a receiving stage for the next volume of liquid, and after the stage receives the volume it moves it along to the next subsequent stage; voltage isolation is maintained between transporting and receiving stages as the sequence progresses. FIG. 1 illustrates this sequence of events, showing the transporting method between two subsequent stages. At step 201 a controlled volume of liquid is metered into stage N, and at step 202 the inlet valve into stage N is closed. At step 203 the volume of liquid is moved from stage N into stage N+1, and at step 204 the inlet valve into stage N+1 is closed. At step 205 stage N is voltage isolated from stage N+1, in a manner which will be hereinafter described, and the cycle with respect to stage N repeats back to step 201. In the meantime, at step 206 the liquid volume in stage N+1 is transported to the next subsequent stage, i.e., stage N+2. At step 207 stage N+1 becomes voltage isolated from stage N+2, and the sequence with respect to stage N+2 is repeated back to step 203. The sequence may be repeated in one or more subsequent stages as evidenced by arrow 208, or arrow 208 indicates the final transport step wherein the controlled liquid volume is moved to the spray apparatus.

Figure 2:
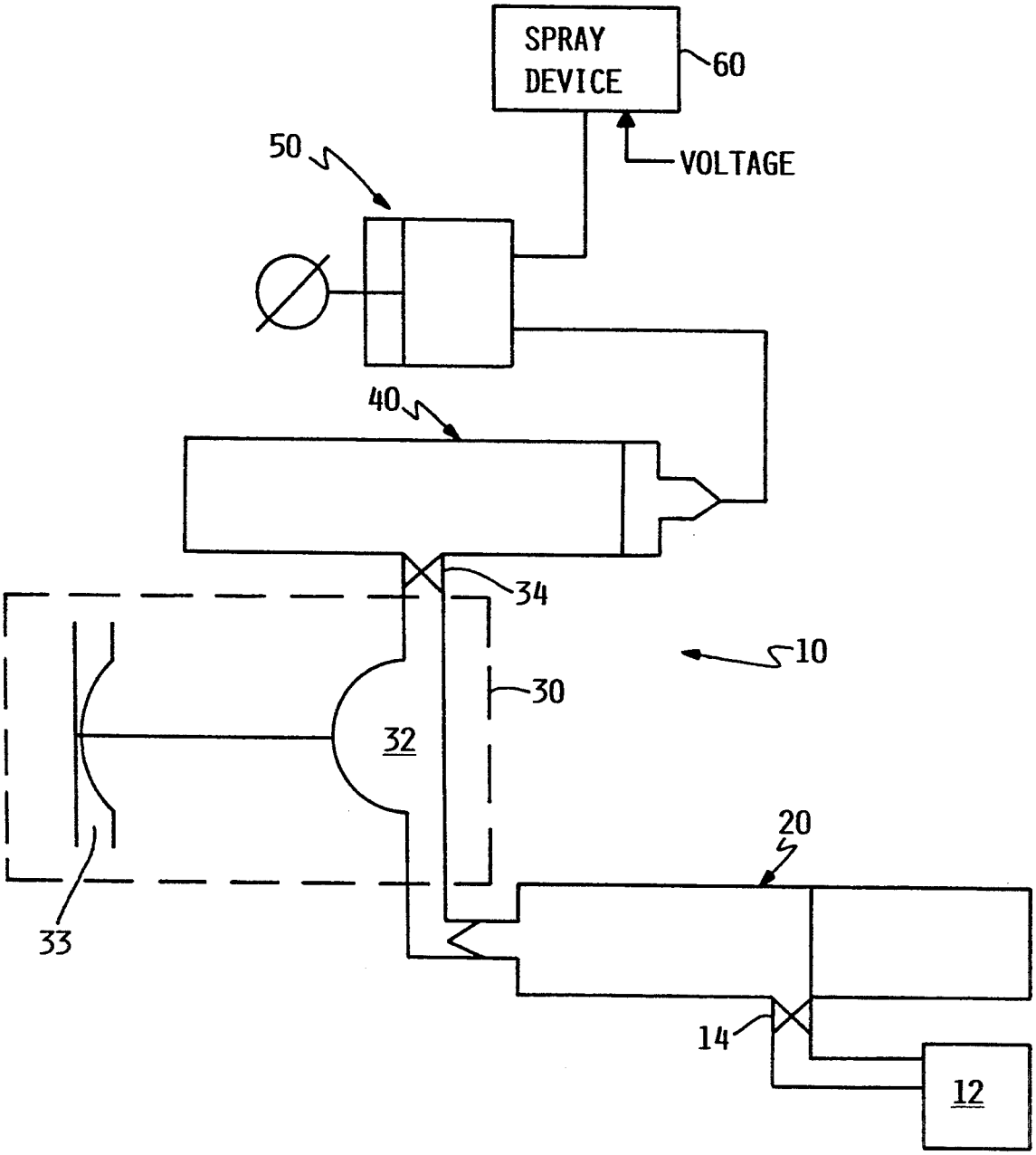
FIG. 2 shows a diagram of one embodiment of the invention.

FIG. 2 shows a symbolic diagram of a preferred embodiment of the present invention. A liquid delivery system 10 has a container or reservoir 12 for retaining a quantity of the liquid to be sprayed by a spray apparatus 60. The liquid from container 12 is pumped through a control valve 14 into a metering valve 20. The liquid is delivered by the metering valve 20 into a diaphragm pump 30, and from there through a control valve 34 into a second metering valve 40. The liquid is delivered from metering valve 40 into an accumulator 50, and the liquid is delivered from the accumulator 50 to a spray apparatus 60. A high-voltage potential may be applied to the liquid in accumulator 50, or may be directly applied to the spray apparatus 60.

The diaphragm pump 30 is preferably a two-chamber pump, having a pumping chamber 32 for receiving and pumping the liquid to be sprayed, and having a pumping chamber 33 for pumping solvent as will be hereinafter described.

Figure 3A:
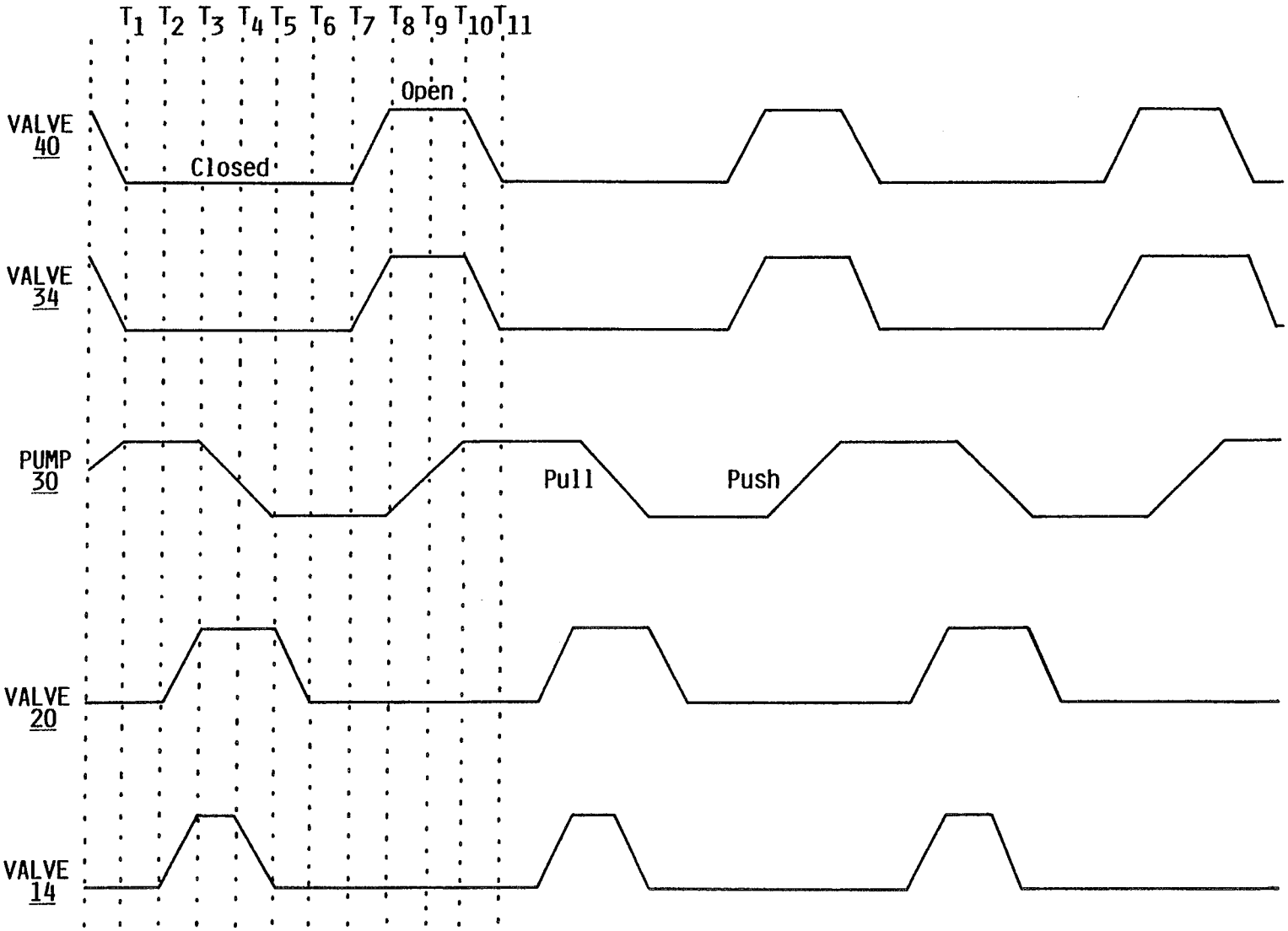
FIG. 3A shows a timing diagram related to the embodiment of FIG. 2.

FIG. 3A illustrates the timing sequences for operating the valves 14 and 34, the metering valves 20 and 40, and the pump 30. For example, control valve 34 is initially closed at time $T_1$, thereby blocking the inlet to metering valve 40. Control valve 14 is also initially closed. The diaphragm pump 30 is initially in a compression stroke in pumping chamber 32 at time $T_1$.

At time $T_1$ intake valves 14 and 34 are in the "off" condition, and both metering valves 20 and 40 are "closed," i.e., in their forwardmost position and essentially empty of liquid. Diaphragm pump 30 is near the end of a compression stroke in chamber 32. At time $T_2$ intake valve 14 begins to open to admit liquid into metering value 20, which begins to retract toward its open position. At time $T_3$, metering valve 20 is in its fully open position and continues to receive liquid through inlet valve 14, and diaphragm pump 30 begins a suction stroke in chamber 32, which continues until time $T_8$. At time $T_5$ metering valve 20 begins moving forwardly toward a closed position, thereby forcing liquid into chamber 32 of diaphragm pump 30 in aid of the diaphragm pump 30 suction stroke. At time $T_5$ inlet valve 14 has been closed to prevent liquid in metering valve 20 from being pushed backward through the inlet.

At time $T_6$ metering valve 20 has reached its forwardmost position and diaphragm pump 30 reaches the maximum suction stroke with respect to chamber 32. At time $T_7$ inlet valve 34 opens to provide an inlet into metering valve 40, and valve 40 begins to move toward an open position, to permit liquid to be admitted into the metering valve via valve 34. At time $T_8$ metering valve 40 is fully open and continues to receive liquid through inlet valve 34, and diaphragm pump 30 begins a compression stroke to move liquid into metering valve 40 via valve 34. The compression stroke proceeds until after time $T_{10}$, while metering valve 40 moves toward a closed position at time $T_{11}$. The cycle thereafter repeats itself for subsequent repetitive sequences, maintaining isolation between the liquid volume in metering valve 20 versus the liquid volume in metering valve 40, by the selective activation of diaphragm pump 30.

Figure 3B:
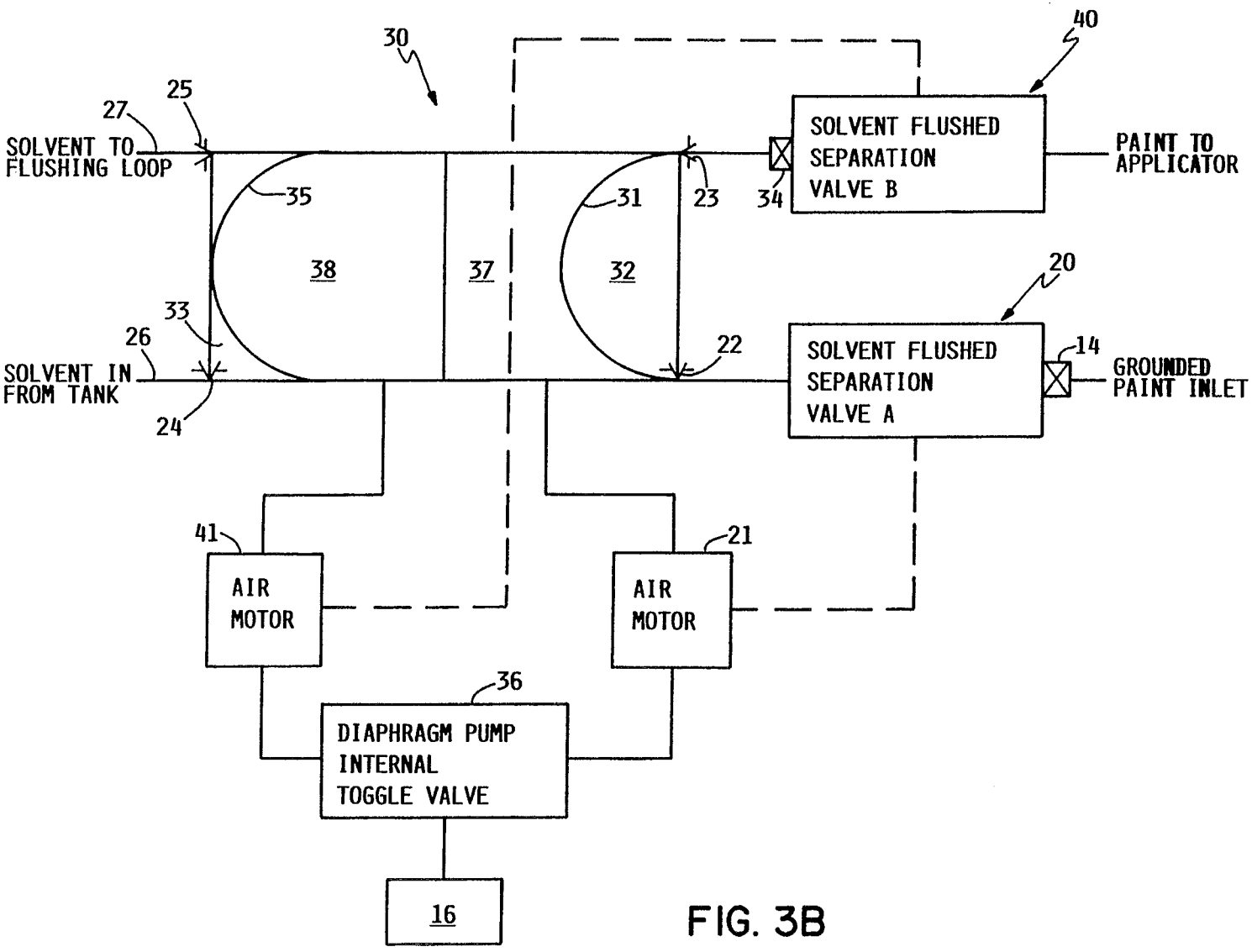
FIG. 3B shows a diagram of the embodiment of FIG. 2 in further detail.

FIG. 3B shows a diagram of the embodiment of FIG. 2 in further detail. The metering valve 20 is mechanically linked to an air motor 21, and metering valve 40 is mechanically linked to an air motor 41. Air motors 21 and 41 are operably connected to a source of compressed air 16, via a valve 36 which is internal to the diaphragm pump 30. Valve 36 is an air toggle valve, mechanically linked to diaphragms 31 and 35 to toggle pressurized air into one or the other of the diaphragm chambers 37 or 38. The operation of diaphragm pump 30 and its toggle valve 36 is described in copending application Ser. No. 08/095,092, filed Jul. 20, 1993, owned by the assignee of the present invention. Air motor 21 is coupled to one of the toggle valve 36 outlets, placing it in series with the pressurized air chamber of diaphragm pump 30 associated with the movement of diaphragm 31. Air motor 41 is coupled to the second outlet from toggle valve 36, placing it in series relationship to the air chamber of diaphragm pump 30 associated with the movement of diaphragm 35. The diaphragm pump described in the aforementioned patent application can be readily modified to accomplish these changes, by merely redirecting the toggle valve air passages to the respective air motors, and adding air passages from the air motors back to the diaphragm air chambers. Therefore, pressurized air from toggle valve 36 will first drive air motor 21, and subsequently drive diaphragm 31. Likewise, pressurized air from toggle valve 36 will first drive air motor 41 and subsequently diaphragm 35. These series air connections provide the timing relationships illustrated in FIG. 3A, associated with metering valve 20, diaphragm pump 30, and metering valve 40.

FIG. 3B also shows connections between the metering valves 20 and 40 and diaphragm pump 30, specifically pumping chamber 32. An intake valve 22 admits liquid from metering valve 20 into the pumping chamber 32, and prevents the reverse flow of liquid from pumping chamber 32 back into metering valve 20. An exhaust valve 23 admits liquid from pumping chamber 32 into metering valve 40 (via intake valve 34), while preventing reverse flow of liquid back into pumping chamber 32. Likewise, an intake valve 24 admits liquid into pumping chamber 33 via an intake line 26, and an exhaust valve 25 permits the flow of liquid from pumping chamber 33 to an outflow line 27. Intake line 26 is preferably connected to a solvent reservoir, to be hereinafter described, and outflow line 27 is preferably connected to the respective metering valves, to be hereinafter described.

Figure 4B:
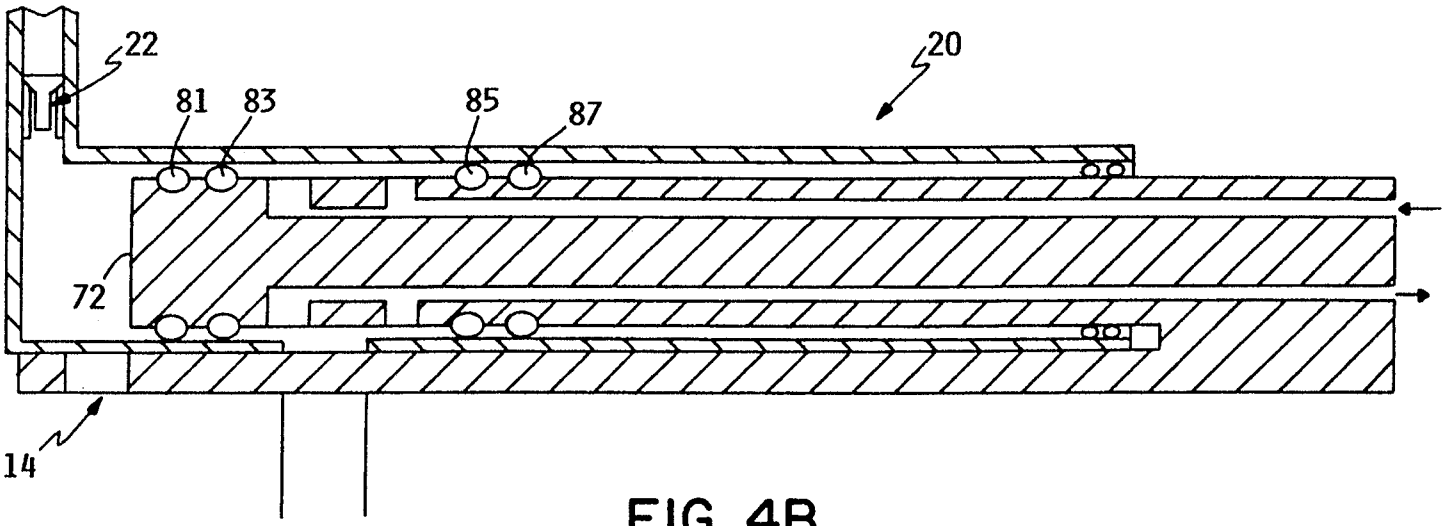
FIG. 4B shows the further embodiment of the invention in a second position.
Figure 4A:
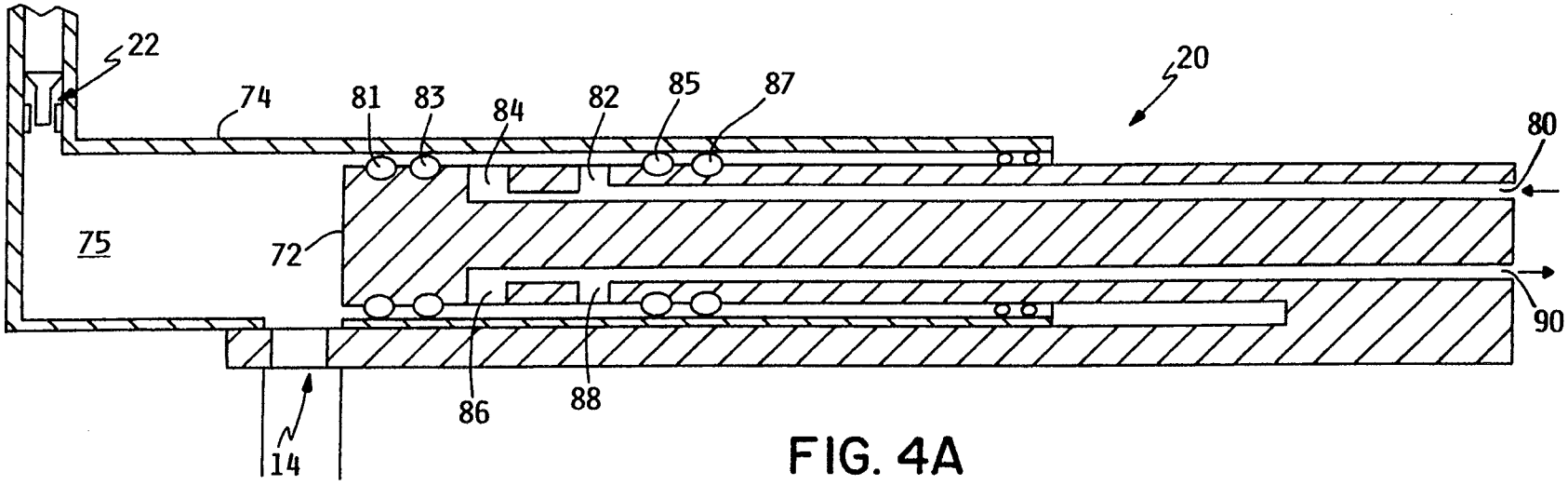
FIG. 4A shows a further embodiment of the invention in a first position.

FIG. 4A shows a further diagram of the metering valve 20; metering valve 40 has an identical construction. In the position shown in FIG. 4A, metering valve 20 is in its fully open position; i.e., the position occurring at time $T_3$–$T_5$. Metering valve 20 has a plunger 72 which is mechanically connected to air motor 21. In the view of FIG. 4A, plunger 72 is just beginning its forwardly movement inside housing 74, to begin ejecting the liquid previously collected in chamber 75. Control valve 14 remains open during this transitional stage, but begins closing at time $T_4$. As plunger 72 moves leftward it ejects the liquid entrapped in chamber 75 through check valve 22, until it reaches its leftmost position as shown in FIG. 4B, at time $T_6$. Plunger 72 and valve 14 remain in the position shown in FIG. 4B until time $T_{12}$, when the cycle becomes repeated.

FIGS. 4A and 4B further illustrate certain passages within plunger 72 for the circulation of a nonconductive solvent. For example, nonconductive solvent may be injected into passage 80 which runs longitudinally inside of plunger 72, to exit passages 82 and 84. The solvent then passes about the interior walls of housing 74 and is returned via passages 86 and 88 to outlet passage 90. O-rings 81, 83, 85, 87 prevent the nonconductive solvent from leaking past the confined region shown in the drawings. As plunger 72 moves leftwardly, the confined region of solvent also moves leftwardly, to effectively clean the interior walls of housing 74, thereby to remove any trace of conductive liquid residue from clinging to the walls. Therefore, when plunger 72 reaches its leftward position shown in FIG. 4B, the interior walls of housing 74 have been fully purged of any residue-conductive liquid from chamber 75. As a result of this cleaning function, electrical isolation is maintained between control valve 14 and check valve 22.

Figure 5A:
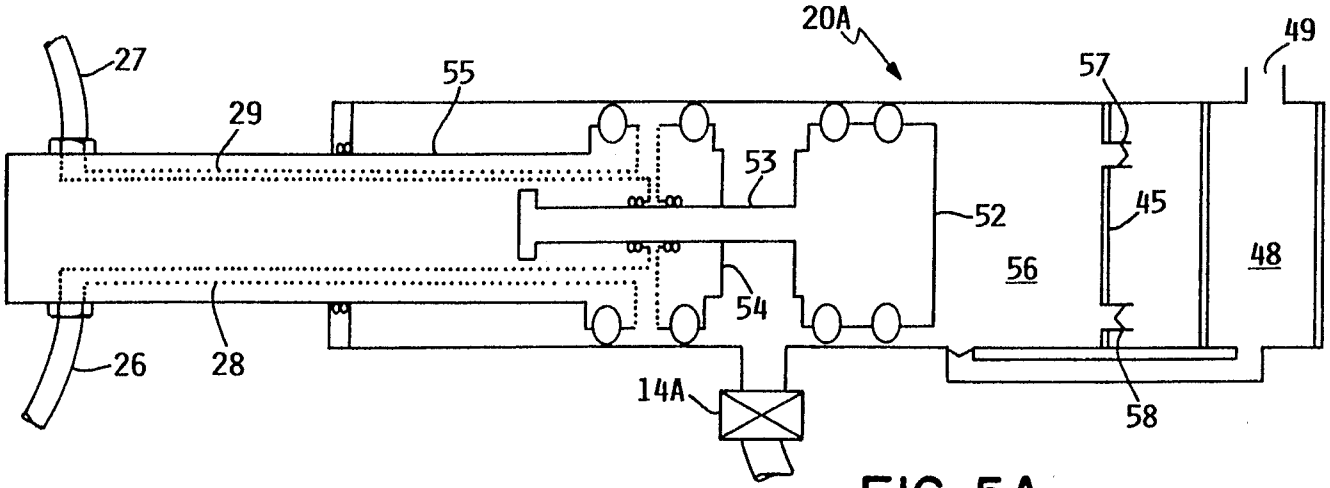
FIG. 5A shows a still further embodiment of the invention in a first position.
Figure 5B:
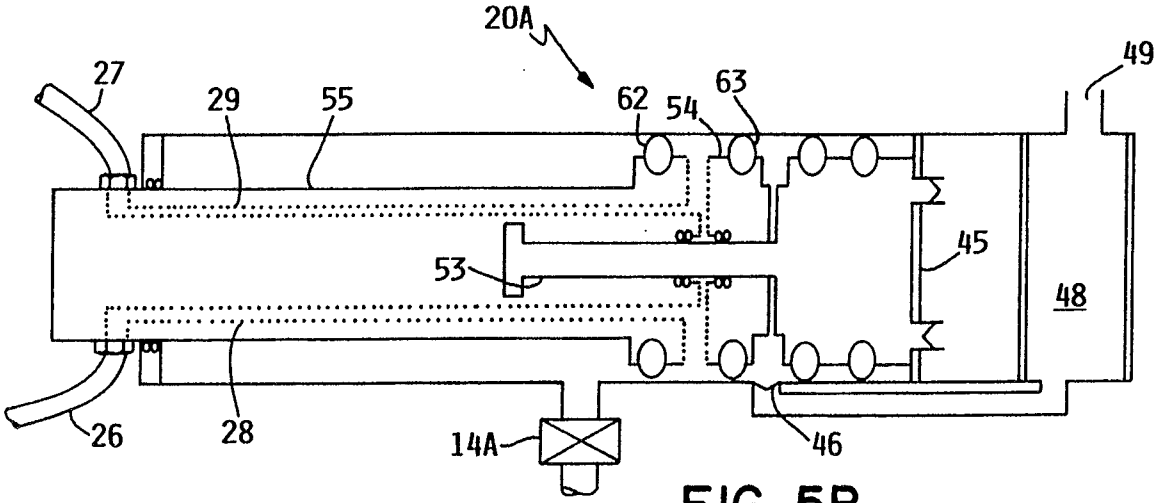
FIG. 5B shows the still further embodiment of the invention in a second position.
Figure 5C:
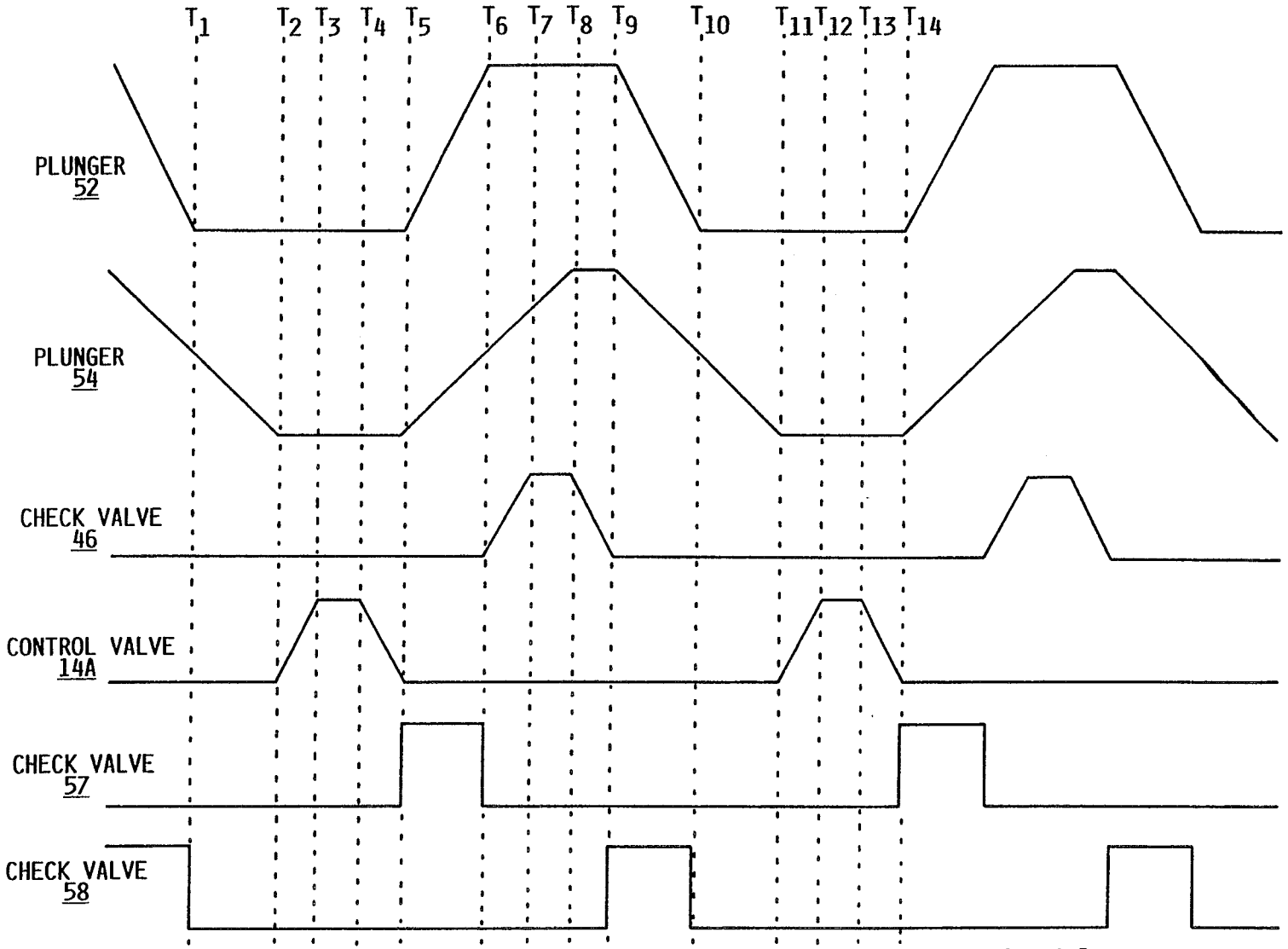
FIG. 5C shows a timing diagram related to the embodiments of FIGS. 5A and 5B.

FIGS. 5A and 5B show an alternative diagram of a metering pump 20A, which could be utilized in the system, and FIG. 5C shows a timing diagram for operating the system. Metering pump 20A has a pair of interactive plungers 52, 54, wherein plunger 52 has a connecting rod 53 which is slidably received within plunger 54. Plunger 54 is affixed to a connecting rod 55, which is operatively connected to air motor 21 (see FIG. 3B). During the transition to a fully-open position, plungers 52 and 54 moved leftwardly in response to the mechanical force applied to connecting rod 55 (times $T_9$– $T_{11}$). Plunger 52 arrives at a stopped position at time $T_{10}$ as illustrated in FIG. 5A and FIG. 5C, while plunger 54 continues a leftward movement until time $T_{11}$, thereby increasing the distance between plungers 54 and 52. Liquid is injected via control valve 14*a* into the space created between the two plungers 52, 54, during times $T_{11}$–$T_{13}$. When plunger 54 arrives at the end of its stroke (time $T_{11}$), air motor 21 reverses the drive direction to connecting rod 55, and the entire assembly begins rightward movement at time $T_5$. FIG. 5B shows a rightward position, at the completion of the metering pump stroke. Plunger 52 is forced rightwardly until it encounters cylinder wall 45 (time $T_6$), wherein it becomes stopped. Plunger 54 continues its rightward movement, forcing the liquid entrapped between plungers 52 and 54 to flow through the check valve into chamber 48, and then outwardly through outlet 49.

The passages 28, 29 within connecting rod 55 provide a flow path for the circulation of nonconductive solvent during the operation of metering pump 20A. Solvent line 27 receives solvent via outlet check valve 57 during times $T_5$–$T_7$, from a solvent chamber 56 which is formed between piston 52 and cylinder wall 45, and this solvent is circulated through passage 29 to the region between O-rings 62, 63. The solvent is circulated outwardly via passage 28 to solvent line 26, which forms a return passage to the solvent chamber 56 via inlet check valve 58 at times $T_9$–$T_{11}$.

Lines 26 and 27 are respectively connected as shown in FIGS. 5A and 5B, and therefore the solvent flow has the effect of cleaning residue material from the interior walls of metering pump 20A, and circulating the residue through a solvent storage reservoir (not shown). This has the effect of flushing conductive residue material from the interior cylinder walls while the plunger 54 is moving toward a closed position, to thereby eliminate any conductive path which might otherwise exist along the interior cylinder walls. O-rings 62 and 63 confine the solvent flow path to the region of the interior wall surface of metering valve 20A which exists between the two O-rings.

Figure 6:
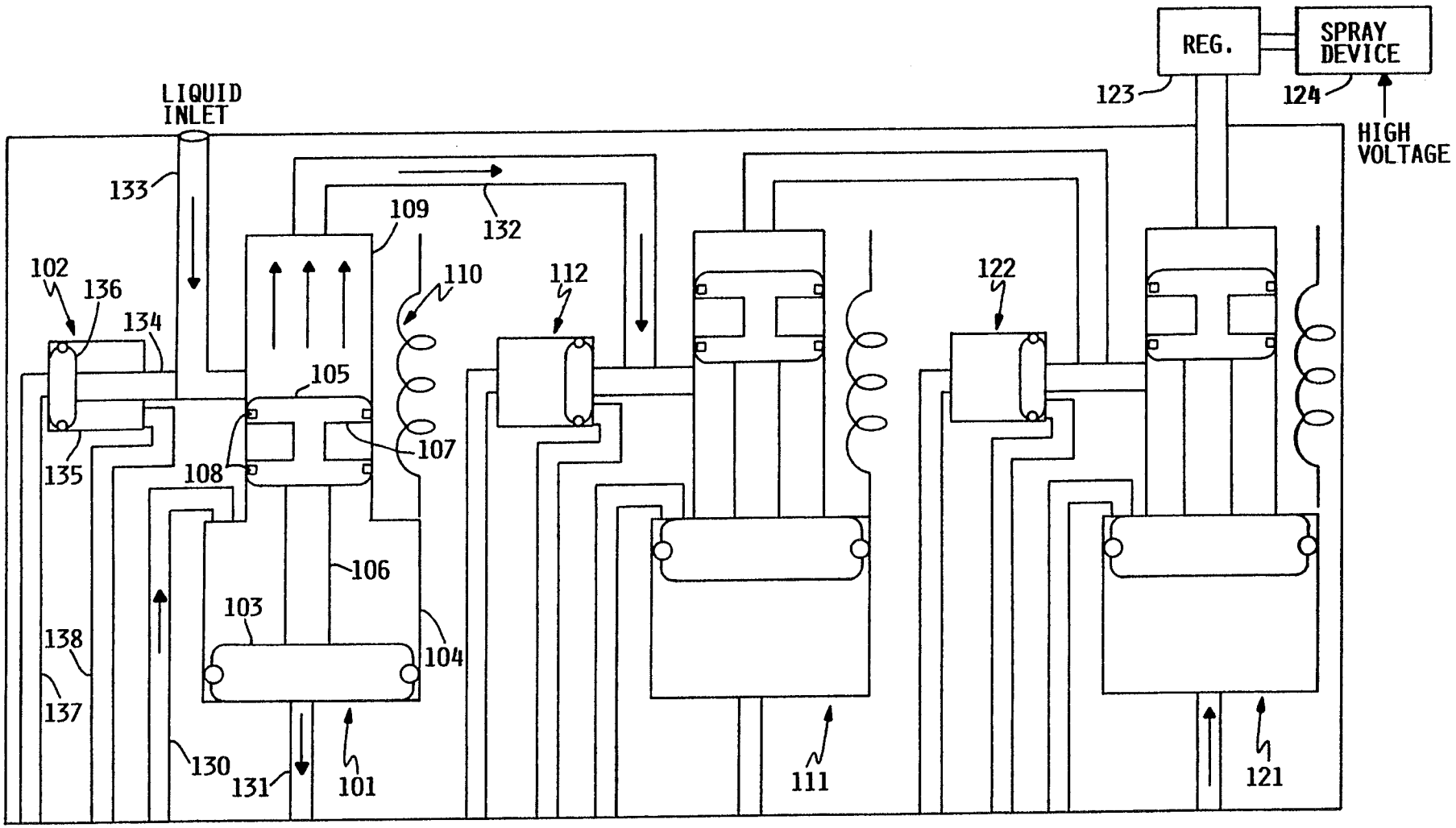
FIG. 6 shows yet another embodiment of the invention.

FIG. 6 shows a further embodiment of a plurality of metering valves for use with the present invention. This embodiment utilizes three metering valves 101, 111, and 121; all three of the metering valves are of identical construction. The embodiment also utilizes three control valves 102, 112, and 122. Each of the control valves are of identical construction, and are preferably located in a single nonconductive housing. Description of the metering valves will be made with reference to metering valve 101, and description of the control valves will be made with reference to control valve 102. Metering valve 101 comprises a piston 103 which is movable within a cylinder 104. Piston 103 is affixed to a plunger 105 via a shaft 106. Plunger 105 has an enlarged annular groove 107 arranged about its circumference, and groove 107 is preferably filled with a nonconductive substance such as paraffin, wax or the like, which substance exists in solid form at room temperatures and may be heated to change to a medium viscosity liquid form. The use of a nonconductive solvent or liquid may also be preferable with this embodiment. A heater 110 is arranged proximate to the housing 109 within which plunger 105 is slidably movable. A pair of O-rings 108 sealably confines the material in groove 107 from escaping outside the groove 107. Air conduits 130 and 131 are respectively coupled into cylinder 104, one on either side of piston 103. A liquid conduit 132 is coupled into the interior of housing 109, leading to the liquid inlet port of metering valve 111. A second liquid conduit 133 is also coupled to the interior of housing 109, and a valve actuator 134 extends from control valve 102 to either block or open the flow path via liquid conduit 133.

Control valve 102 has an internal piston 136 connected to valve actuator 134, and piston 136 is slidably movable within control valve 102 housing 135. An air conduit 137 is coupled to the interior of housing 135, and a second air conduit 138 is also coupled to the interior of housing 135, each air conduit being coupled on opposite sides of piston 136. In operation, pressurized air may be admitted into conduit 130 and withdrawn from conduit 131, as shown by the arrows in FIG. 6, to drive piston 103 downwardly until it contacts the lower interior wall of cylinder 104. The pressurized air flow may be reversed in direction through conduits 130 and 131 to drive piston 103 upwardly until it hits the upper wall of cylinder 104. Plunger 105 moves correspondingly with piston 103, from a lower position wherein liquid conduit 133 is opened into housing 109, to an upper position where the liquid within housing 109 is forced outwardly through liquid conduit 132. Pressurized air may be admitted into air conduit 138 and circulated outwardly from conduit 137, to move piston 136 leftwardly until it contacts the interior walls of housing 135. Conversely, the pressurized air flow conduits 137 and 138 may be reversed to move piston 136 rightwardly, and also to thereby move valve actuator 134 into blocking relationship relative to liquid conduit 133.

The sequence of operation of metering valve 101 and control 102 can best be understood from FIG. 6. First, pressurized air is admitted into conduit 130, thereby moving piston 103 to its lowest position as illustrated in FIG. 6. Next, pressurized air is admitted into conduit 138, thereby moving piston 136 leftwardly and removing valve actuator 134 from liquid conduit 133. Next, pressurized liquid is admitted into the housing 109 via liquid conduit 133 to fill the interior of the housing; the pressurized liquid may also fill conduit 132 for some distance along the conduit. Control valve 112 is then opened (after retracting the piston of metering valve 111) to permit the liquid to pass between metering valve 101 and metering valve 111. Control valve 102 is then actuated by admitting pressurized air into conduit 137, thereby blocking conduit 133 with valve actuator 134. Pressurized air is next applied to conduit 131 to force piston 103 upwardly, thereby driving all liquid from within housing 109 externally outwardly through conduit 132.

Heater 110 may be activated to heat the housing 109, and thereby to heat the material filling groove 107 in plunger 105. This material is selected to have a low temperature melting point, and also to be electrically insulative. As a result, the liquified material in groove 107 effectively wipes the interior wall surfaces of housing 109 to clean therefrom any residue of the liquid which fills housing 109. This wiping action effectively breaks any electrically-conductive path which might otherwise exist between conduits 132 and 133.

The operation of metering valves 111 and 121 is substantially similar to the operation of metering valve 101, wherein the respective control valves restrict entry of the liquid materials into the metering valve until the metering valve has been retracted and placed in a position to accept the liquid, after which the previous metering valve will be fully stroked so as to clean any residue-conductive material from the interior housing walls. Therefore, metering valve 111 is opened to admit liquid via conduit 132, then plunger 105 and metering valve 101 will travel upwardly, forcing the liquid into metering valve 111. In the next sequence, metering valve 121 is retracted to receive liquid via its inlet conduit, and control valve 122 permits this liquid to enter the metering valve, but only then the plunger in metering valve 111 will travel upwardly, forcing the liquid to the spraying device, and to wipe residue-conductive material from the inside wall surfaces of the metering valve. The sequence described above is repeated, resulting in the isolated movement of liquid into regulating device 123 and to spraying device 124.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for conveying conductive liquids to an electrostatic spraying device for providing electrical isolation of the liquid source from the spraying device, comprising:

a) a first metering valve in liquid flow communication with said liquid source, said first metering valve having an outlet port;

b) a liquid pump having an inlet in flow communication with said first metering valve outlet port, and having an outlet check valve;

c) a second metering valve in liquid flow communication with said pump outlet check valve, said second metering valve having an outlet port;

d) an electrostatic spray device in flow communication with said second metering valve outlet port; and e) control means for sequentially filling said first metering valve with a predetermined volume of said liquid, and for transporting said predetermined volume to said pump, said second metering valve and said spray device, so that said predetermined volume does not simultaneously contact said first and second metering valves.

2. The apparatus of claim 1, wherein said liquid pump further comprises a diaphragm pump connected to a source of pressurized air.

3. The apparatus of claim 2, wherein said diaphragm pump further comprises an internal air valve operable by mechanical connection to a diaphragm in said pump.

4. The apparatus of claim 3, wherein said control means further comprises a pair of air motors respectively connected via air passages to said diaphragm pump air valve, each of said air motors respectively mechanically connected to one of said first and second metering valves.

5. The apparatus of claim 4, wherein said diaphragm pump further comprises two diaphragm chambers, each of said chambers respectively connected to receive pressurized air from one of said air motors.

6. The apparatus of claim 1, further comprising means for flushing said first and second metering valves with nonconductive solvent.

7. The apparatus of claim 6, wherein said liquid pump further comprises a diaphragm pump having two pumping chambers, a first chamber in flow communication with said metering valves, and a second chamber in flow communication with said means for flushing said metering valves.

8. The apparatus of claim 7, wherein said diaphragm pump further comprises an internal air valve mechanically connected to diaphragms in said diaphragm pump.

9. The apparatus of claim 8, wherein said control means further comprises a pair of air motors respectively connected to said diaphragm pump internal air valve, each of said air motors respectively mechanically connected to one of said first or second metering valve.

10. The apparatus of claim 9, further comprising means for respectively connecting air passages in said air motors to said first and second pumping chambers.

11. An apparatus for conveying conductive liquids to an electrostatic spraying device for providing electrical isolation of a conductive liquid source from the spraying device, comprising:

a) a first pump having an inlet connected to said conductive liquid source, and having a first outlet;

b) a second pump having an inlet connected to said first outlet, and having a second outlet;

c) a third pump having an inlet connected to said second outlet and having a third outlet;

d) wherein each of said first, second and third pumps further comprise a piston reciprocable within a cylinder, said piston having an annular groove therein; and a nonconductive seal filling said annular groove;

e) first, second and third control valves respectively connected to said inlets of said first, second and third pumps.

f) a spraying device connected to said third outlet; and g) means for sequentially driving said first, second and third pumps to sequentially move a volume of said conductive liquid from said liquid source to said spraying device comprising means for sequentially controlling said first, second and third control valves.

12. The apparatus of claim 11, wherein said nonconductive seal further comprises a material having a solid form over a first temperature range and a liquid form over a second temperature range, higher than said first range.

13. The apparatus of claim 12, wherein said nonconductive seal further comprises paraffin.

* * * * *